United States Patent [19]

Redmond

[11] Patent Number: 4,819,406

[45] Date of Patent: Apr. 11, 1989

[54] COMPACT FORM-FILL-SEAL MACHINE FOR AUTOMATIC PRODUCTION OF SEALED PACKAGES

[75] Inventor: Sanford Redmond, Stamford, Conn.

[73] Assignee: Sanford Redmond Inc., Bronx, N.Y.

[21] Appl. No.: 101,227

[22] Filed: Sep. 25, 1987

[51] Int. Cl.[4] ..... B65B 61/18; B65B 47/02

[52] U.S. Cl. ..... 53/51; 53/133; 53/559

[58] Field of Search ..... 53/51, 559, 133, 373, 53/412, 453

[56] References Cited

U.S. PATENT DOCUMENTS

| | | | |
|---|---|---|---|
| 3,530,636 | 9/1970 | Weprin et al. | 53/559 X |
| 3,673,760 | 7/1972 | Canamero et al. | 53/559 X |
| 3,874,143 | 4/1975 | Braber | 53/559 X |
| 3,979,877 | 9/1976 | Vetter | 53/51 |
| 3,996,726 | 12/1976 | Schlachter | 53/51 X |
| 4,012,888 | 3/1977 | Nichols | 53/559 X |
| 4,018,028 | 4/1977 | Donnet | 53/51 |
| 4,240,241 | 12/1980 | Sanborn, Jr. | 53/133 X |
| 4,349,997 | 9/1982 | Hayasaka et al. | 53/51 |
| 4,444,610 | 4/1984 | Torterotot et al. | 53/133 X |
| 4,493,574 | 1/1985 | Redmond et al. | |
| 4,611,715 | 9/1986 | Redmond | |
| 4,725,329 | 2/1988 | Tani | 53/133 X |

*Primary Examiner*—Horace M. Culver

*Attorney, Agent, or Firm*—Morgan & Finnegan

[57] ABSTRACT

A compact form-fill-seal machine for producing sealed cups and other sealed package structures, including dispenser packages for flowable substances having a fault line extending over a stress concentrating protrusion member.

5 Claims, 11 Drawing Sheets

COMPACT FORM-FILL-SEAL MACHINE FOR AUTOMATIC PRODUCTION OF SEALED PACKAGES

BACKGROUND AND OBJECTS OF THE INVENTION

1. Field of the Invention

The present invention relates generally to form-fill-seal machines and, more particularly, to certain new and useful improvements in the manufacture of such machines in an unusually compact size capable of producing sealed cups and other sealed package structures with increased efficiency.

2. Description of the Prior Art

"Form-fill-seal" is the generic name for a type of machine in which a first thermoformable plastic web is indexed (in most cases, intermittently) to a heating station where the web is brought to forming temperature and then indexed to a forming station where the heated plastic web is drawn by vacuum or pressed by air pressure, or both, either over or into one or more forming dies to thereby form the web into the desired configuration, usually a cup-like cavity.

During the time of forming at the forming station, the web is normally clamped continuously about the periphery of each forming die. Also, the forming dies typically are retractably mounted so that, once the desired formation is made in the web, the die retracts and the formed web is then able to advance to a filling station, which delivers a discrete predetermined amount of product into each cup-like formation.

Simultaneous with the formation and filling of the aforesaid first web, a second web, usually in an upper position and printed, either in a continuous pattern, which requires no registration, or in a design which must be in accurate registration with the bottom web formation so that a complete single pattern or. design will be located over each cup or other formation in the first web.

The second upper web, by means of various rollers, is brought into parallel proximity with the formed and filled lower web and then indexed simultaneously in printed register therewith, where necessary, to a sealing station. At the sealing station, retractable heated sealing dies clamp and seal the lower formed and filled web to the upper web and then withdraw to permit further indexing of the sealed packages to a final station where the individual packages are separated and delivered to a packing or loading station.

In general, previously known form-fill-seal machines for packages are large, unwieldy, and extremely expensive. For example, a widely used machine for producing plastic cups of butter, margarine and the like is approximately 25 ft. long and costs in the neighborhood of $400–$500 Thousand (U.S.), yet only produces on the order of 500 cups per minute of 5-gram size.

OBJECTS OF THE INVENTION

It is therefore an object of this invention to provide a new and improved machine for automatically producing filled and sealed cups or other package structures.

Another object of this invention is to provide a new and improved machine for automatically producing filled and sealed cups or other package structures which is more compact in size and produces package structures more efficiently than previously known machines.

Another object of this invention is to provide a new and improved machine for automatically producing filled and sealed cups or other package structures which is unexpectedly cheaper to manufacture than previously known machines and yet has approximately equal production capabilities.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations, steps and improvements herein shown and described.

It will be understood that the foregoing general description and the following detailed description as well are exemplary and explanatory of the invention but are not restrictive thereof.

The accompanying drawings, referred to herein and constituting a part hereof, illustrate a preferred embodiment of the invention, and together with the description, serve to explain the principles of the invention.

DESCRIPTION OF THE PREFERRED EMBODIMENTS

Figure 1:
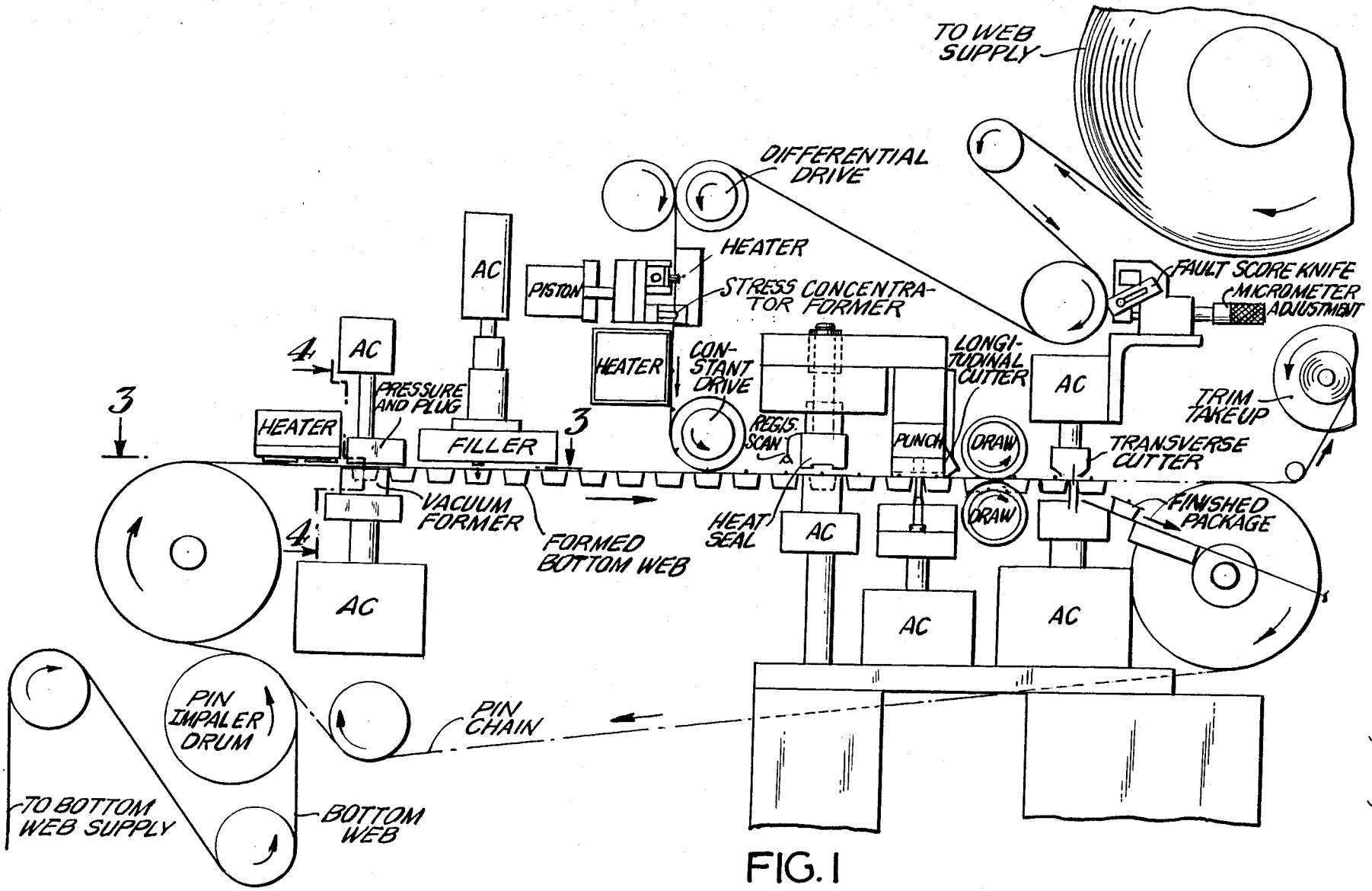
FIG. 1 is a side elevation, partly schematic, of a form-fill-seal machine construction embodying the present invention capable of producing a sealed package structure having a fault line extending across a stress concentrating protrusion member formed in the top surface of the package.

Referring now more particularly to FIGS. 1-16 of the accompanying drawings, there is illustrated a preferred embodiment of a form-fill-seal machine constructed in accordance with the present invention. As here preferably embodied, the machine is advantageously adapted for simultaneously forming, filling and sealing four sealed packages, here in the configuration of the dispenser package described in Redmond et al U.S. Pat. Nos. 4,493,574 and 4,611,715, the disclosures of which are hereby incorporated by reference.

While the apparatus of my invention as here embodied is particularly adapted to and was designed for use in the production of my previously patented dispenser package structure, the principles underlying the operation of the invention are not limited to such usage. However, since the invention is particularly adaptable to such usage, reference will be made hereinafter thereto in order to provide an example of a practical and useful embodiment of the invention.

It will also be understood that the invention is not limited to the simultaneous production of four packages, but may be readily adapted to the simultaneous production of more or less packages as desired. While my invention is not limited to the production of any particular size package, it is particularly well suited for the production of relatively small packages, containing on the order of a few grams to on the order of 4 oz. of product.

Turning now to the drawings, it will be seen that a bottom thermoformable plastic web is indexed intermittently to a heating station where it is brought to forming temperature and thereafter indexed to a forming station which has one or more female forming dies.

It will be seen that the bottom web is transported (indexed) to the various stations by a pair of "pin" chains, which are simply roller chains with a series of sharp pins impaled on the pins by an impaling drum along the selvage (edge) on both sides of the bottom web material. It will be understood that other alternative means of gripping the bottom web may be used, such as clamping clips mounted on a roller chain, but these are expensive and have not been found to hold any advantage over the use of simple pins which have been found to securely grip the web.

At the forming station, either a vacuum is drawn through very small holes in the female dies, which draws the heated plastic web into the configuration of the female dies, or alternatively, air pressure may be applied from above the web to press the heated web into the die configuration. Also, as a further alternative, a combination of pressure and vacuum may be used.

During the time of forming, the web is normally clamped continuously about the periphery of each female die. This female die is kept cool by either air or liquid coolant. If desired, this clamping mechanism can also drive a preforming plug into the heated plastic to assist and control the web thickness after forming by a variety of means. For example, such a plug may be heated or cooled, and may be made of a variety of materials, ranging from aluminum to Teflon plastic to achieve a broad range of effects and results.

The forming dies and clamping mechanism are retractably mounted, and once the cup-like pocket formations are formed in the bottom web, the die retracts downwardly while the clamping mechanism rises, enabling the formed web to advance to a filling station, where the filler mechanism delivers a predetermined amount of product into each cup-like pocket formation.

Simultaneous with the formation and filling of the bottom web, an upper web, usually printed, either in a continuous pattern which requires no registration or in design which must be accurately registered to the bottom web formation so that a total single pattern or design will be located on each individual package being produced. As more fully described hereinafter, the machine as here preferably embodied has the capability of producing such registered location of print design when a thermoformable plastic upper web material is used, although it can operate equally well with continuous pattern designs. The upper web is brought, by means of a differential drive roller and a constant drive roller, into parallel proximity with the now formed and filled bottom web. It is then indexed simultaneously with the bottom web, in printed register, where necessary, to a sealing station. This sealing station by means of heated sealing dies and a clamp mechanism seals the lower formed and filled web to the upper web again by retractable heated sealing dies which withdraw to permit further indexing of the sealed packages.

To separate the individual packages, longitudinal cutting means preferably comprised of sharpened tungsten carbide blades, slit the package from the pin chain as well as between the packages longitudinally. In addition to the pin chain, a set of upper and lower driven draw rollers are mounted so as to pull the web through the slitting blades. The packages are then indexed to a final station where they are chopped off crosswise by guilliotine type knife blades. In order to create rounded or beveled corners on the packages after the longitudinal and transverse slitting operations, a die punching station is preferably located in the index sequence just before the first slitting takes place after the upper and lower webs are sealed. Alternatively, if just the lower web is desired to be punched, the punch die could be located at an earlier station, either before or after forming but before the filling station.

A machine as here embodied as been constructed on the order of 60" (5 feet) long, as compared to the previously mentioned approximately 25 foot long commercial machine, and yet has the same or a somewhat higher output and can be manufactured to sell for less than one-half the price of the aforesaid machine.

The key feature and reason behind the unexpected small size and efficient operation of the machine of this invention is believed to be that a basic physics concept has been overlooked in the development of the prior machine, namely, the formula for inertia, $MV^2$ (Mass times Velocity squared). Thus, the aforesaid prior machine takes 30 cups per cycle in a $5\times6$ configuration while the instant machine has a configuration of $10\times2$, or 20 cups per cycle. The essence of the cycling rates is the $V^2$ factor (velocity squared). Running the $10\times2$ configuration at 30 to 40 cycles per minute, $2\times1\frac{1}{4}=2\frac{1}{2}$" ($2\frac{1}{2}$ inches per cycle) is much easier than moving $7\frac{1}{2}$" per cycle:

$$(7\tfrac{1}{2})^2=56.25$$

$$(2\tfrac{1}{2})^2=6.25$$

It becomes clear that the acceleration/deceleration forces for a $7\frac{1}{2}$" index is 9 times greater than for a $2\frac{1}{2}$" index. Much greater power input, much heavier construction, and much greater breaking force all contribute to operating inefficiency.

If the portion of cycling movement time is 33% of the entire cycle, then $$\tfrac{1}{3}\times9=3$$

Thus, mechanical efficiency on this phase alone of the entire machine is 3:1. If 20 cups are produced at 3 times the efficiency that 30 cups are produced, 60 cups are, in effect, produced on the small machine for every 30 cups produced on the large machine, with the attendant savings. Add to this other similar savings throughout the machine and it will be seen that significant size and cost reductions can be made (certainly at least 50%).

Referring now to certain specifics of the machine as here illustrated and preferably embodied, the bottom forming web generally ranges from 4–8 mils in thickness, depending on the desired size of the package, depth of draw, desired barrier qualities, etc. The materials from which this web can be made may range from simple polystyrene, polypropylene, polyvinylchlorides or polyesters, to multilayer coextrusions. This web is threaded over the pin impaler roller and as the machine is indexed, this bottom forming web is impaled along both its edges onto the two indexing pin chains. These chains index forward in precise increments, controlled by an indexing drive and the illustrated unique positive chain locating system.

The bottom web is first indexed under the radiant or contact heating station where it is brought to forming temperature. It is then indexed forward to a forming station where it is clamped and, where necessary or desirable, plugged, while either air pressure or vacuum or both are applied to the heated web to force it into the cooled female die to achieve the desired formation. The formed web is then indexed to a filling station where flowable product is filled into the formed cavities.

Figure 9:
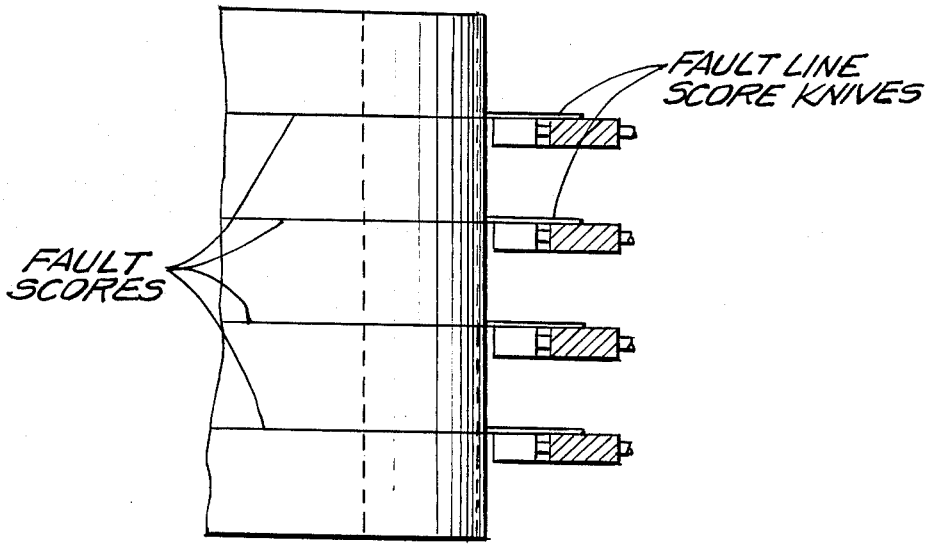
FIG. 9 is a fragmentary bottom plan taken along line 9—9 of FIG. 8, illustrating a multiple of four scoring knives simultaneously forming a fault line for each sealed package being produced.
Figure 10:
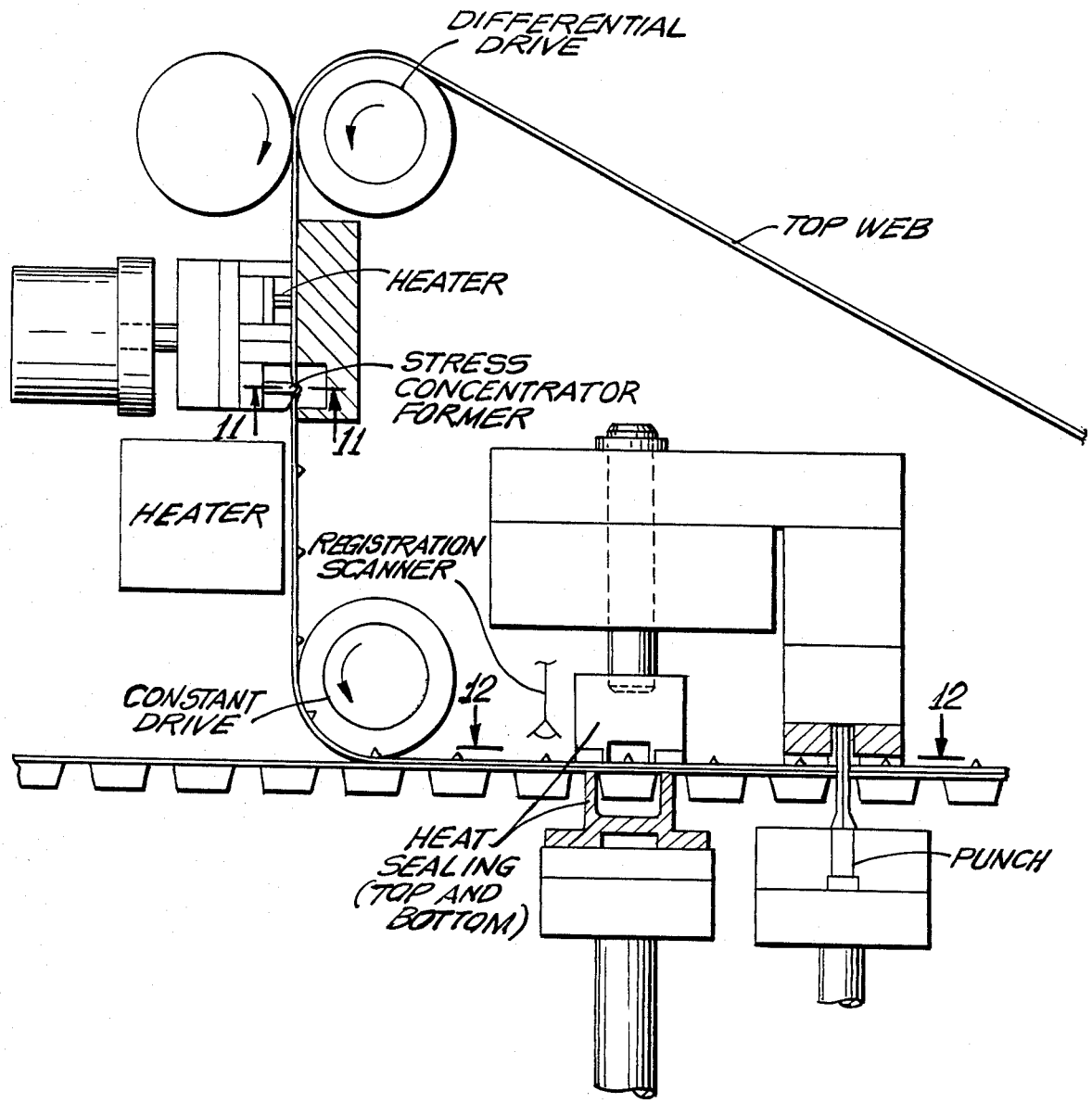
FIG. 10 is an enlarged fragmentary view in side elevation, partly sectional, illustrating the differential and constant drive rollers drawing the top web material past the stress concentrator heating and forming means and into register with the formed and filled bottom web cup-like cavities, the top and bottom heat sealing unit sealing the top web onto the bottom web, the punch die which punches the web at the corner locations for the individual packages, and the photoelectric eye which scans registration of the top and bottom web and transmits a signal to the differential drive roller control for correcting register error.
Figure 11:
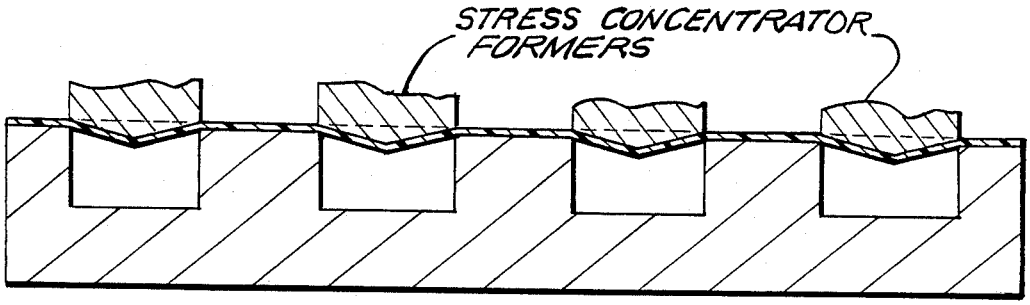
FIG. 11 is an enlarged fragmentary view taken along line 11—11 of FIG. 10, illustrating the stress concentrator forming dies.
Figure 12:
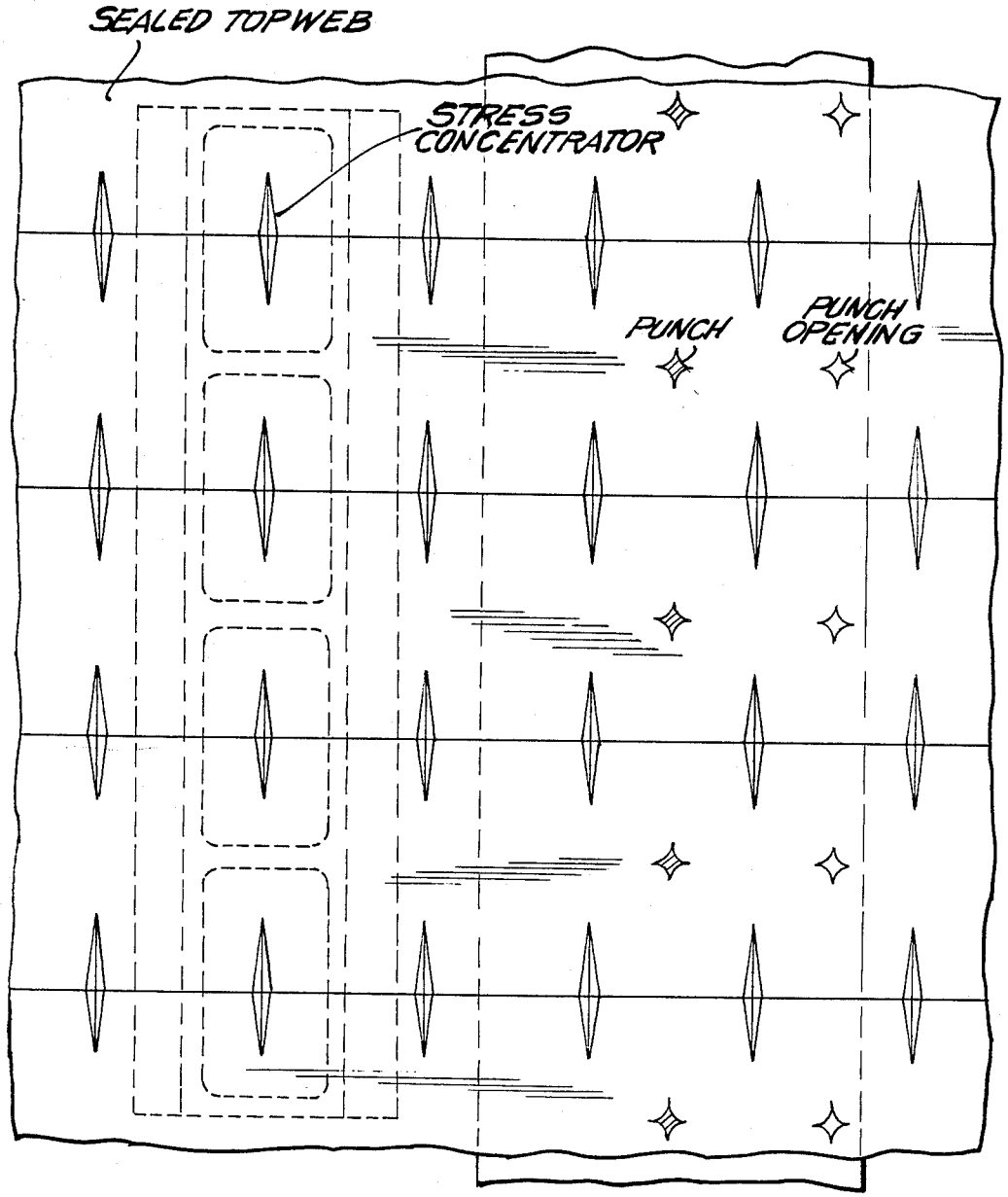
FIG. 12 is an enlarged fragmentary view taken along line 12—12 of FIG. 10, illustrating the punch openings, stress concentrator locations and fault lines formed in the top web member.

As best seen in FIGS. 9–10, while the bottom web is being formed and filled, the top web is being drawn by a pair of pull rollers and indexed simultaneously by the same drive means that indexes the lower web. The upper web is drawn from a supply roll after which it passes over a hard roller directly opposing this roller, where there are a series of very sharp hard blades each independently mounted on a micrometer controlled member. The purpose of these blades is to score the heavier top plastic web creating a fault line.

The aforesaid pair of draw rollers is connected to the main drive through a differential drive system which can slow or increase the amount of top web movement (which is the printed web) in response to a signal from a photoelectric cell which reads a printed spot on the top web to tell whether the print is in register. The upper drive rollers are located so as to draw the top web from the roll through the fault line blades and feed it vertically downwardly to a second draw roller system advantageously approximately 12 inches below.

In the gap between the two draw roller systems there is located a radiant heater as well as a horizontal series of diamond-shaped contact heaters, the center of each diamond heater is in line with the fault lines, followed one index below by a horizontal row of pyramidally-shaped punches and dies. When the web is indexed by the two sets of draw rollers, the diamond heaters, which have a properly preset temperature, are compressed against the top web causing a series of horizontal diamond shaped formable areas on the upper web. At the next index, the pyramidal punch presses these formable diamond areas into the female dies creating a horizontal line of small pyramidal-shaped formations, with the fault line passing through their center. The lower draw roller system has relief areas so that these raised pyramidal protrusions can pass through them without being crushed. As the top web passes through the lower draw roller system, it is transported around the lower roller and travels horizontally above the lower web with its pyramids in register with the bottom web cup-like pocket formations.

The top and bottom webs are thereafter indexed to a sealing station, comprised of a heated lower sealing die which moves vertically to compress the lower web to the upper web. As the lower web sealing die rises, an upper pressure pad descends and both webs are compressed, heated and sealed between these two pads and the lowered sealed die retracts to permit the now formed, filled and sealed stress concentrator package to advance to the punch station.

At the punch station, a series of hard steel punches and dies advantageously punch a "star"-shaped hole in the web at the locations of the corners of the individual packages, trimming the corners of the packages so that they become round. The star-shaped trim is removed by suitable vacuum means.

Figure 13:
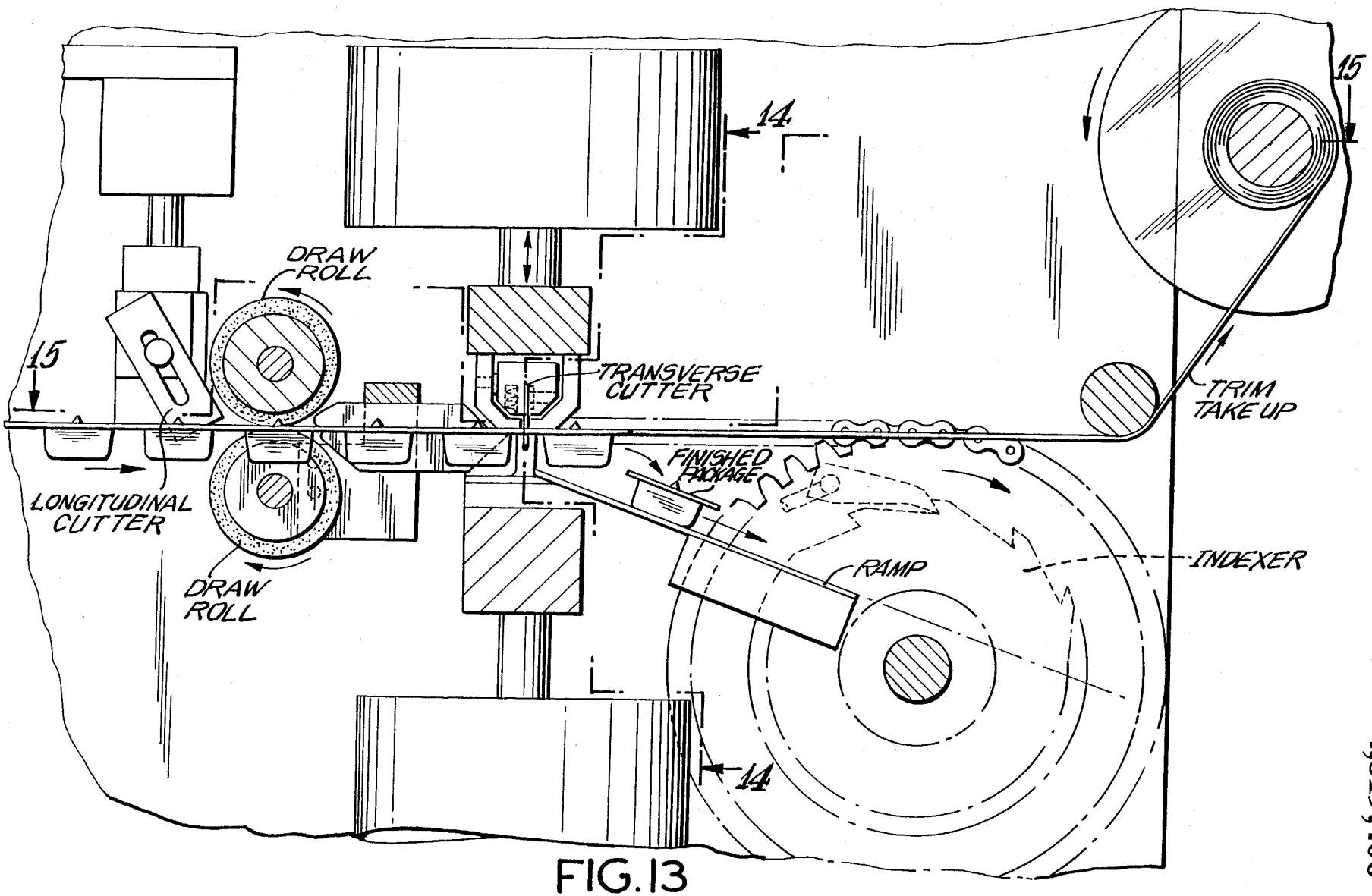
FIG. 13 is an enlarged fragmentary view in side elevation, partly sectional and partly schematic of the indexer drive of FIG. 1, the view also showing the longitudinal and transverse cutters for separating the individual packages, an inclined ramp for receiving the finished packages and the take up roll for the trim waste.
Figure 14:
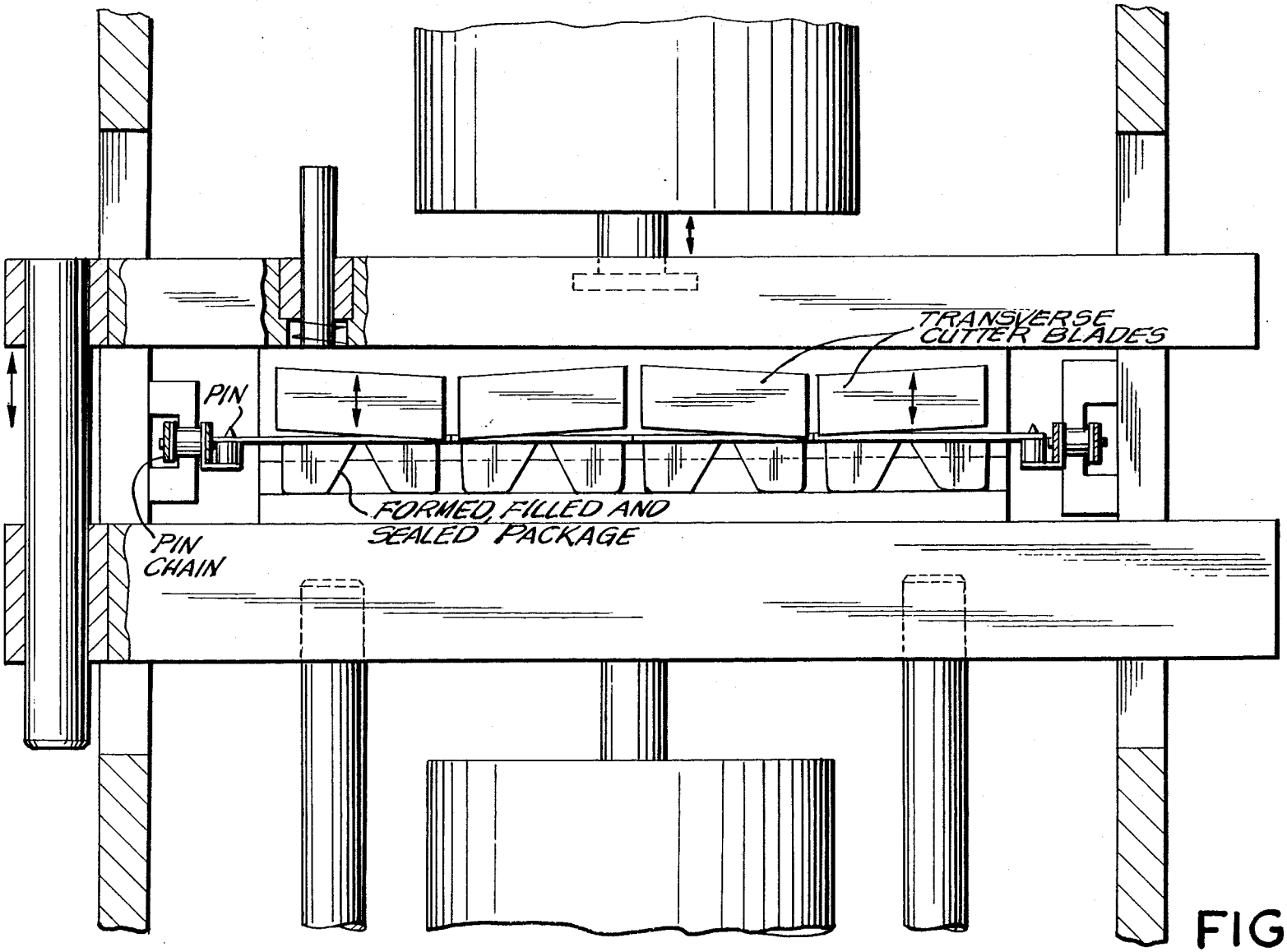
FIG. 14 is an end elevation taken along line 14—14 of FIG. 13, illustrating the transverse cutting blades separating the individual sealed packages.
Figure 15:
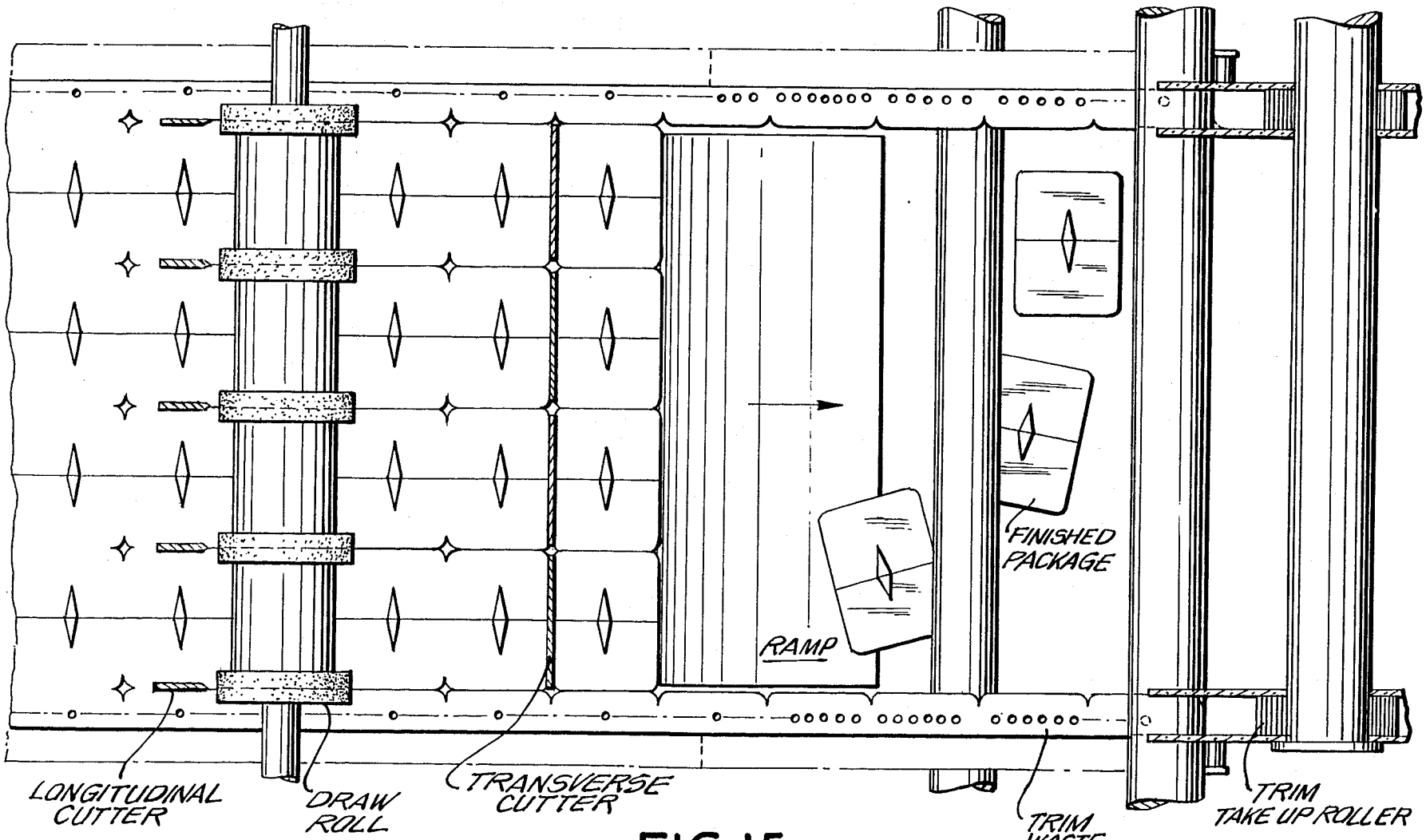
FIG. 15 is a top plan view taken along line 15—15 of FIG. 13.

At the next station, best shown in FIGS. 13 and 15, a series of hard sharp blades, preferably tungsten carbide, slit the individual packages apart into long strips, and a pair of upper and lower auxiliary rollers aid the pin chain in pulling the strip of packages through the blades.

In a final index, a transverse bar containing a series of hard sharp blades (again tungsten carbide) chops through the strips of packages to create a series of individual finished sealed packages. There is left on each pin chain a thin strip of plastic which is rolled up on reels driven by an air motor which slips when the pin chains are at rest or drawn through rollers and chopped into pieces.

The aforesaid machine has a number of other features which give it its extreme flexibility, small size, and economical but high precision construction.

It is completely controlled by a commercially available programmable controller, which is effectively a small computer, such as manufactured by the Allen-Bradley company. It is basically a pneumatic machine so that a huge variety of motions and timings may be accomplished by controlling air valves, air pressure, etc. by the programmable controller.

An alternate method of putting precise depth scores (fault lines) over the stress concentrator and eliminating the sharp hard blades, each mounted on a micrometer controller, is to have a controlled heated blade indent the fault line at the position where it traverses the stress concentrator. This method of indenting the fault line has been used on other machines previously and is not of itself claimed as patentable in this application.

Also, as here embodied, the filler means is unique in that it loads diaphragms which in turn are depressed by pistons loosely fitted into cylinders which are attached to a bar which is driven up and down by an air piston compressing the diaphragms. These diaphragms are attached or clamped to a filler bar on which the air cylinders also are mounted, one for each diaphragm.

The filler bar is bored across its full width to relatively large bores. For ketchup, as an example, the holes are about 1" diameter. One bore is the product entry port and the product is delivered to it under pressure. When the diaphragms are fully filled with product, a valve is actuated by the programmable computer, shutting off the pressure. A rotating valve shaft, traversing the other bore, is then pivoted approximately 30 degrees, aligning cross-drilled holes in it with the outlet nozzles and with holes drilled in the filler bar. The pistons thereupon collapse and press against the filled diaphragms, forcing the product out of the outlet nozzles and into the cup-like pockets formed in the bottom web. Retraction of the piston thereafter creates suction on the nozzles to prevent drip. The valve shaft which traverses the filler bar is suitably sealed at each end with "O" rings or the like to prevent product leak.

The entire filler assembly is mounted in such a manner that it may be flushed in place for cleaning by raising it and placing a special cleaning cap on the bottom of it to direct flushing water and detergent into an outlet hose and not all over the machine.

The invention in its broader aspects is not limited to the specific embodiments herein shown and described but departures may be made therefrom within the scope of the accompanying claims, without departing from the principles of the invention and without sacrificing its chief advantages.

Thus, for example, the top forming system which forms a stress concentrator protrusion member in the top web may be adapted to form any suitable protrusion shape such as, for example, disclosed in U.S. Pat. Nos. 4,493,574 and 4,611,715. As an alternative to the described integral filler for flowable products, an open station for a commercial filler may be provided which could drop nuts and bolts or other solid products, ranging from candies to machine parts to pills, into the cup-like pockets formed in the bottom web.

Figure 17:
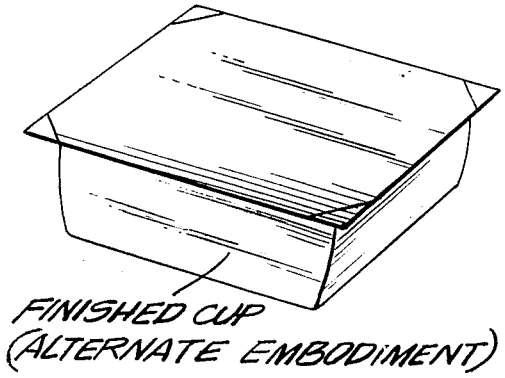
FIG. 17 is a perspective view of an alternate embodiment of the package structure of FIG. 16 which may be produced by an alternate embodiment of the machine construction of FIGS. 1-15.
Figure 3:
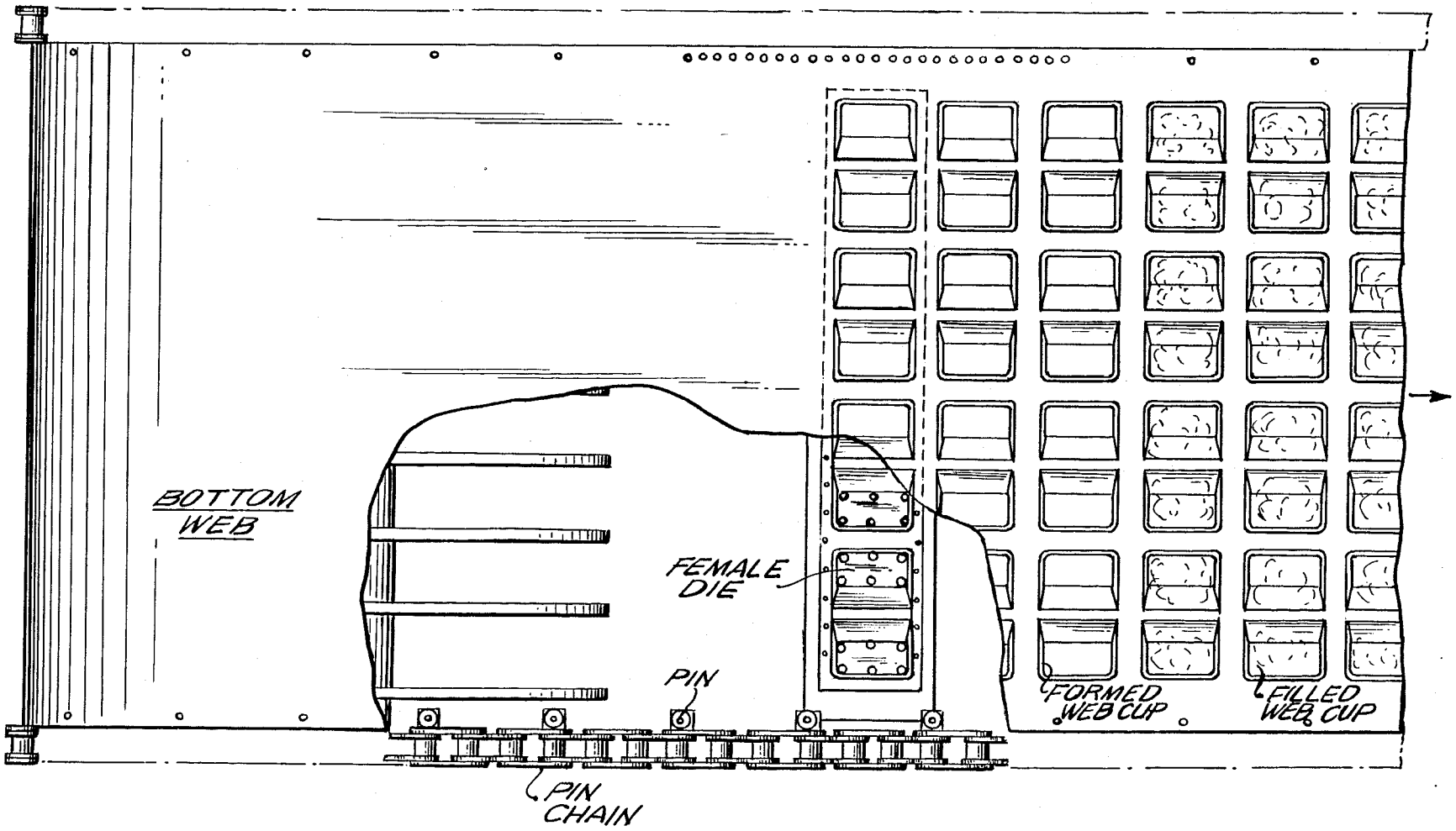
FIG. 3 is a top plan taken along line 3—3 of FIG. 1, illustrating the pin chain drive, female forming dies and formed and filled bottom web cup-like configurations, the view further illustrating a multiple of four package configurations being formed simultaneously in the bottom web, each package having a double-cup cavity configuration.
Figure 4:
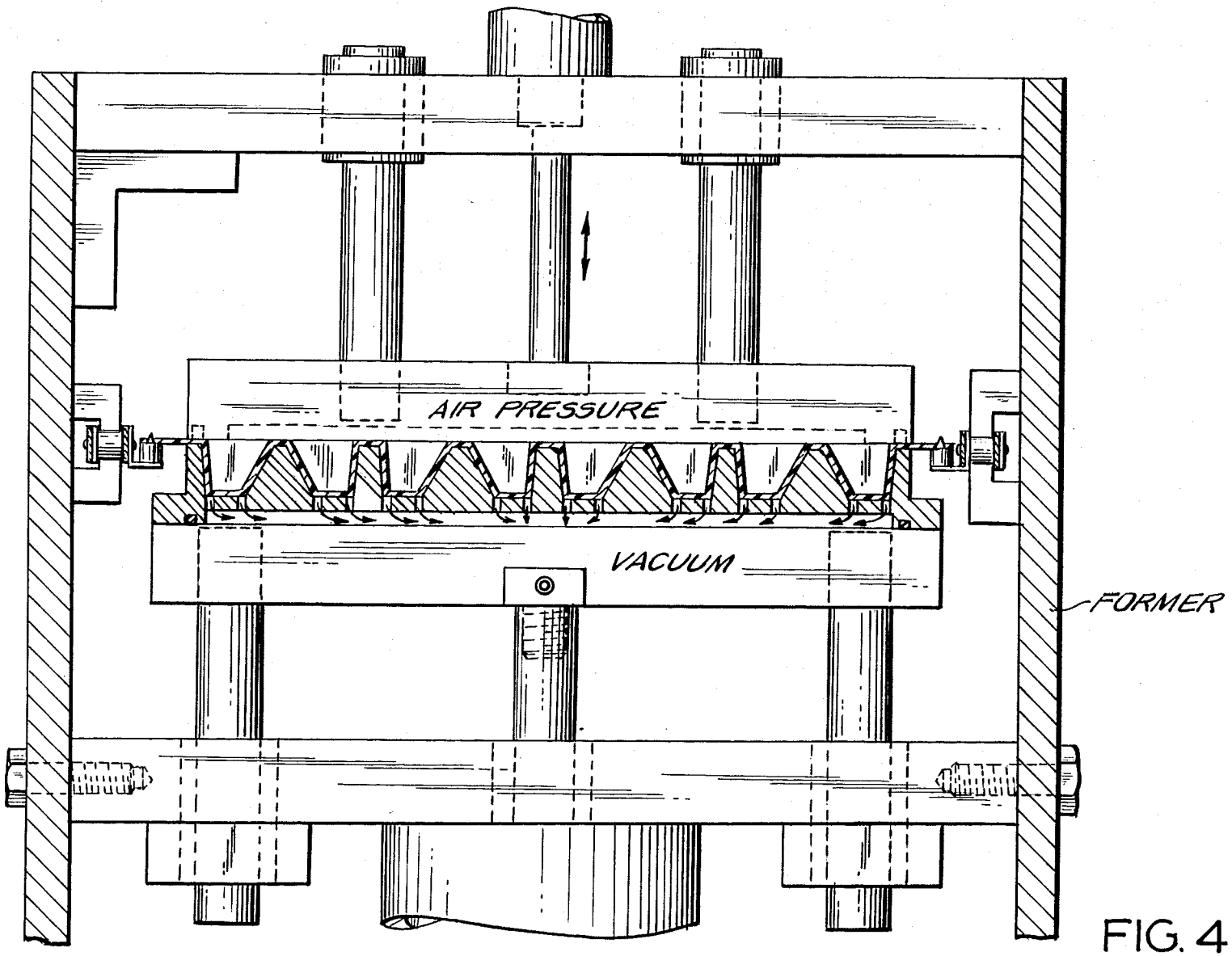
FIG. 4 is an end elevational view, partly sectional, taken along line 4—4 of FIG. 1, illustrating the female forming dies and vacuum and air pressure platens for forming the double cup-like configurations in the bottom web.
Figure 5:
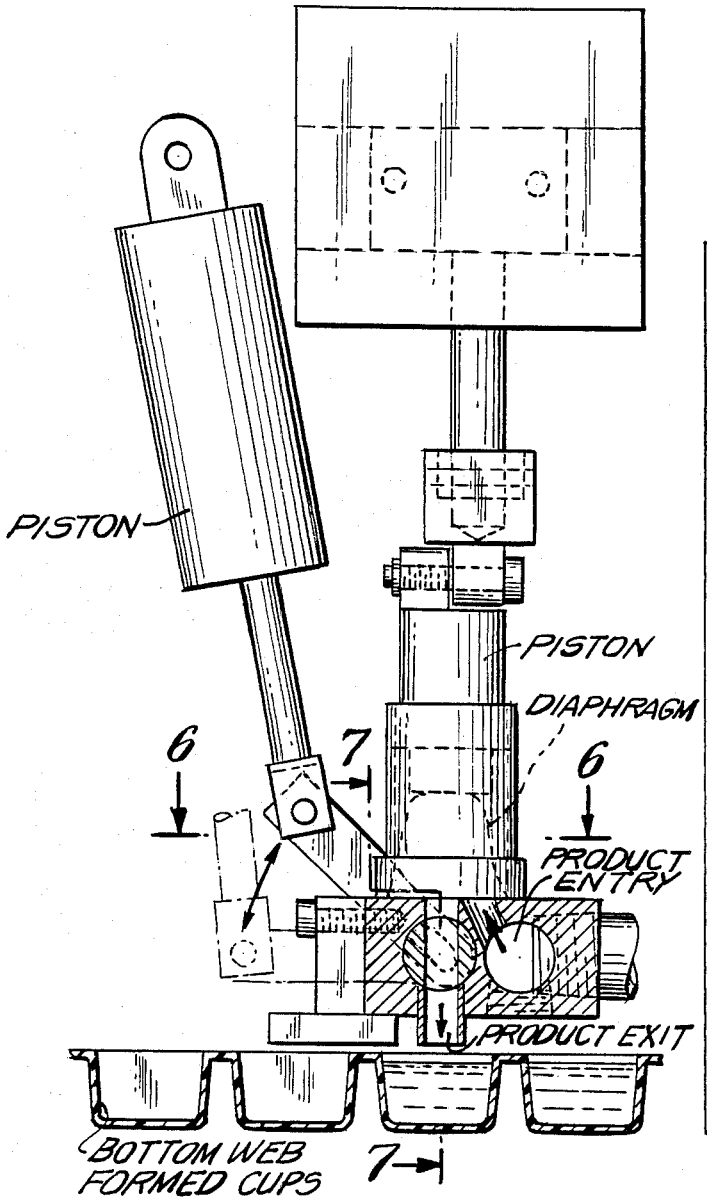
FIG. 5 is an enlarged view in side elevation, partly sectional, of the filler mechanism for depositing a desired flowable substance in equal amounts into each cup-like cavity formed in the bottom web.
Figure 6:
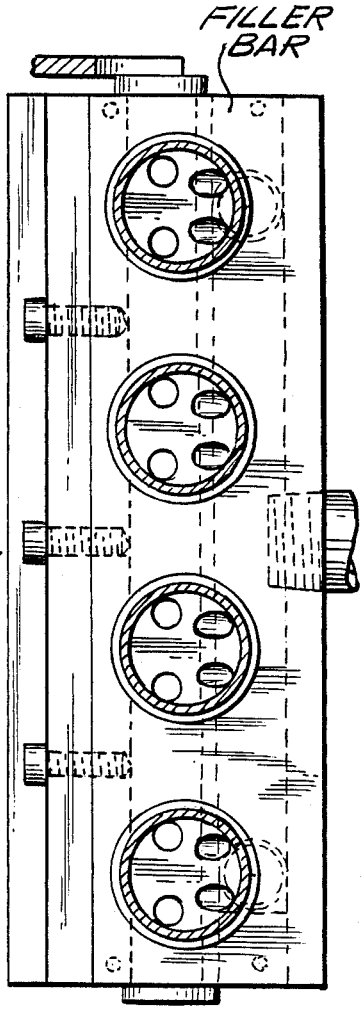
FIG. 6 is a top plan, partly sectional, taken along line 6—6 of FIG. 5, illustrating the product entry ports of the filler bar.
Figure 7:
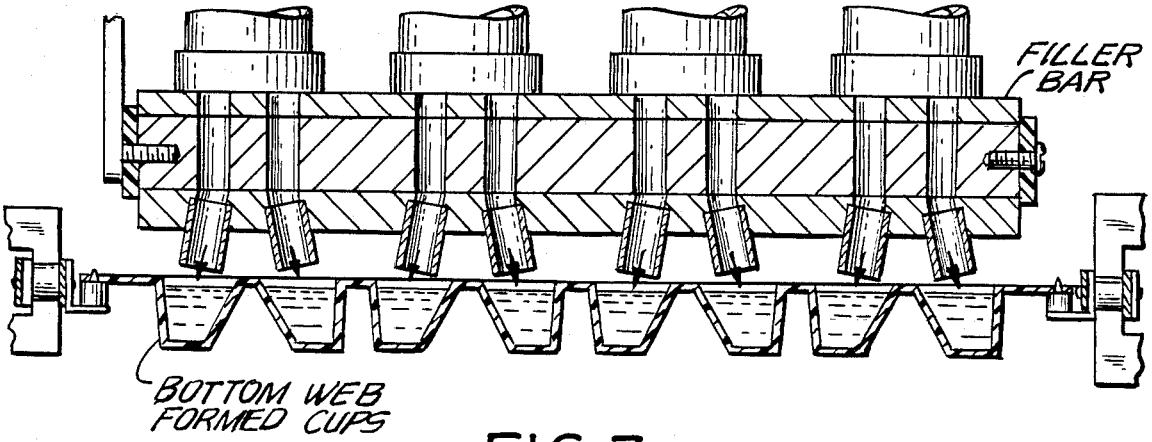
FIG. 7 is a sectional view taken along line 7—7 of FIG. 5, illustrating the product exit ports of the filler bar.
Figure 8:
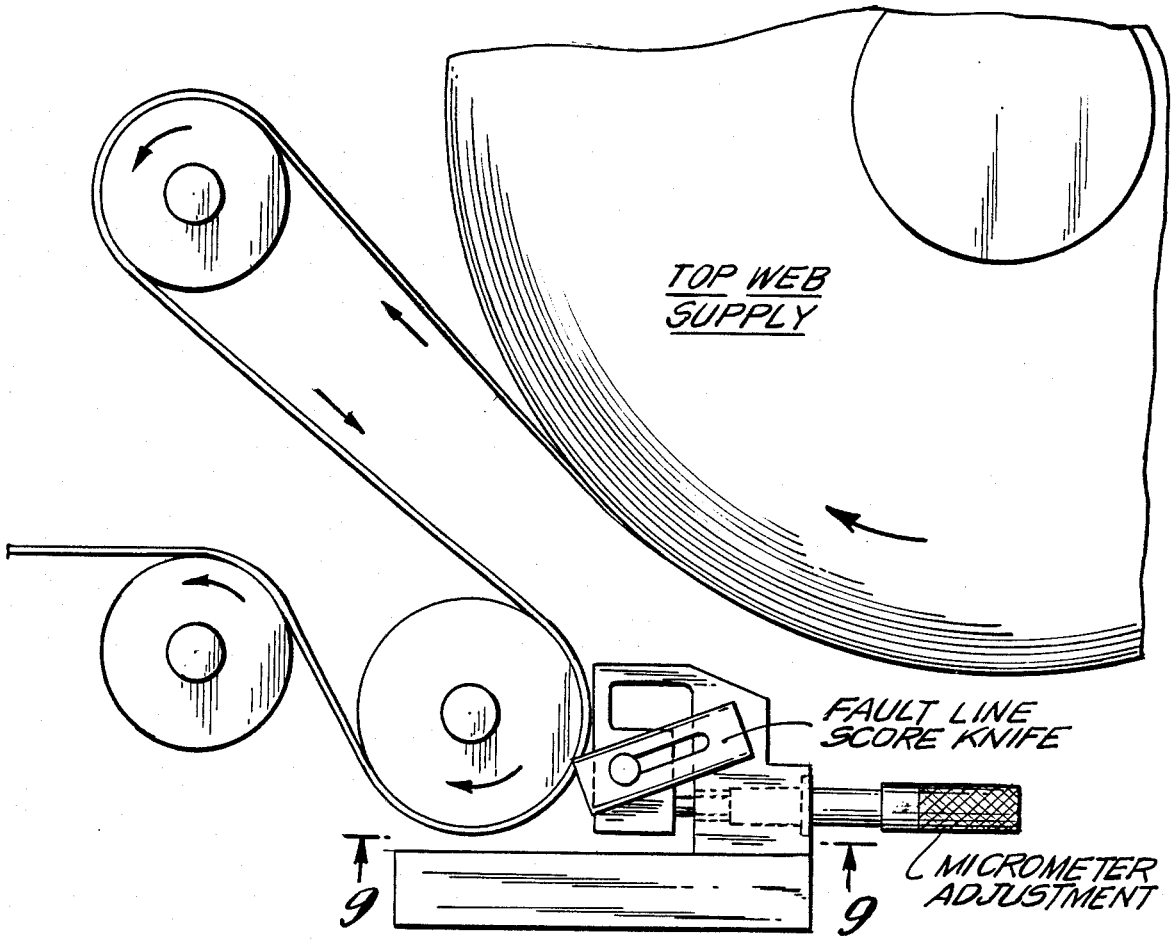
FIG. 8 is an enlarged fragmentary view in side elevation, illustrating the top web supply, fault line scoring knife and micrometer adjusting means for locating the depth of the knife score, shown in FIG. 1.

Finally, it will be understood that the illustrated machine structure could be readily modified to produce a more conventional cup-like package structure as shown in FIG. 17. Such a configuration could be readily produced, for example, by utilizing different web stock and/or thicknesses in the top and bottom supply rolls, modifying the forming die configuration, and eliminating the stress concentrator former.

What is claimed is:

1. A machine for automatically simultaneously producing a predetermined number of filled and sealed finished packages, including:

pneumatically driven adjustable indexing drive means driving a main shaft member;

sprocket means mounted to said main shaft engaging and adapted to intermittently advance and rest a pair of web transporting roller chains in response to movement of said main shaft;

said web transporting roller chains including a series of upstanding pin members;

rotary impaler cylinder means driven by said roller chains;

roller means transporting a bottom thermoformable web material from a supply roll to said impaler cylinder, said impaler cylinder impaling each of the opposed lateral edges of said bottom web onto said roller chain pin members;

means intermittently indexing said bottom web material to a heating station where said web is heated to thermoformability;

means intermittently indexing said heated web to a forming station, said forming station including retractable forming die means forming a series of cup-like pockets in said bottom web;

means intermittently indexing the formed bottom web to a filler station, said filler station including means filling each of said cup-like pockets with an equal amount of a product supplied to said filler station;

driven roller means simultaneously advancing a thermoformable top web material in timed sequence with the intermittent advance, forming and filling of said bottom web member;

said top web driven roller means transporting said top web into substantially parallel closely adjacent proximity to said bottom web after the cup-like pockets formed therein are filled;

means intermittently indexing both said bottom web and said top web together to a sealing station, said sealing station including retractable heat sealing die and clamping means heat sealing the top and bottom webs together;

means intermittently indexing said sealed top and bottom web members to a punch station, said station including a series of punch dies which punch rounded openings in the sealed web members at the location of the corners of the individual packages to be formed;

means intermittently indexing and pulling said sealed top and bottom web members to a longitudinal cutting station wherein knife means slit said top and bottom web members along first opposed sides of said cup-like pockets and adjacent the pin engaging edge portions of said bottom web;

transverse cutting means slitting said top and bottom web members along second opposed sides of said cup-like pockets to thereby separate the individual finished packages from one another;

means transporting said finished packages away from said machine; and take up roller means removing the bottom web trim from said roller chain pins.

2. A machine as claimed in claim 1, including solid state programmable controller means controlling said indexing drive means.

3. A machine as claimed in claim 1, wherein said forming means includes vacuum means drawing said bottom web material into a female forming die and air pressure means simultaneously pressing said web into said forming die.

4. A machine as claimed in claim 1, wherein said top web driven rollers include a differential drive roller, and a constant index drive roller, and including scoring means adapted to indent said top web with a fault line extending partially through the thickness of said web material;

said differential drive and constant index rollers transporting said scored top web past heat means and stress concentrator former means, said stress concentrator former means adapted to form a protrusion in said top web member at said fault line to thereby displace said fault line from the surface of said web; and registration scanner means adapted to detect lack of register between said top web and said cup-like pockets formed in said bottom web, said scanner means including means for sending a control signal to said differential drive means to correct improper register.

5. A machine as claimed in claim I, wherein said filler station is adapted to fill a flowable product into the cup-like pockets formed in said bottom web, said filler station including a filler bar comprising a series of product exit ports located in registry with each cup-like pocket formed in said bottom web, each product exit port communicating with an expandible diaphragm chamber and including valve means for closing said communication, a product entry port communicating with each of said expandible diaphragm chambers, means introducing product to each of said chambers under pressure, means shutting off pressure to said product when each of said chambers is full, and means closing communication between each of said chambers and said exit port when product is being filled into said chamber; and piston means adapted to depress said diaphragm when full to force the product in each of said chambers out said product exit port.

* * * * *

UNITED STATES PATENT AND TRADEMARK OFFICE

CERTIFICATE OF CORRECTION

PATENT NO. : 4,819,406

DATED : April 11, 1989

INVENTOR(S) : Sanford Redmond

Figure 2:
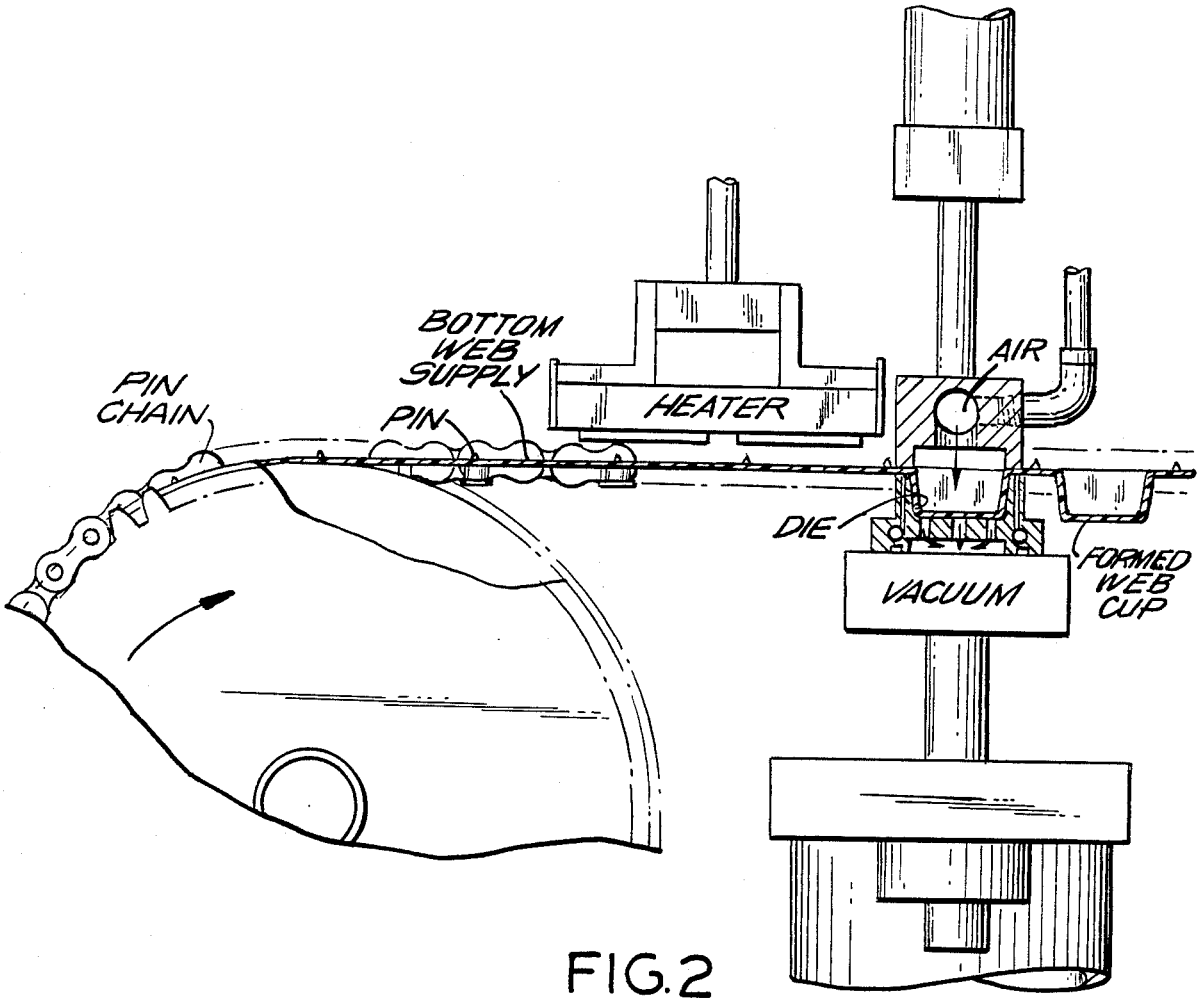
FIG. 2 ian enlarged fragmentary view in side elevation, partly sectional, illustrating the bottom web heating and vacuum and air pressure forming means forming cup-like cavities in the bottom web member.
Figure 16:
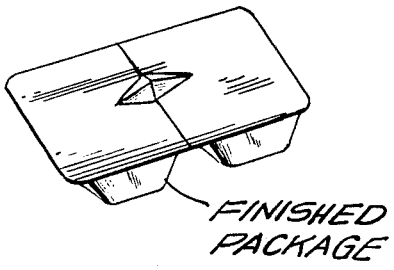
FIG. 16 is a perspective view of a finished package produced by the machine construction shown in FIGS. 1-15.

It is certified that error appears in the above-identified patent and that said Letters Patent is hereby corrected as shown below:

In Col. 2, line 32, after "FIG. 2", "ian" should read -- is an --.

In Col. 4, line 7, after "sharp pins" and before "impaled" insert -- mounted on them along their entire length. The bottom web is --.

In Col. 5, line 9, "as", second occurrence, should read -- has --.

Signed and Sealed this

Thirteenth Day of February, 1990

*Attest:*

JEFFREY M. SAMUELS

*Attesting Officer*

*Acting Commissioner of Patents and Trademarks*